US006001178A

United States Patent [19]

Borgmann

[11] Patent Number: 6,001,178

[45] Date of Patent: Dec. 14, 1999

[54] METHOD AND APPARATUS FOR APPLYING UNIFORM LAYERS OF ADHESIVE TO CONTOURED SURFACES OF A SUBSTRATE

[75] Inventor: Robert E. Borgmann, Maineville, Ohio

[73] Assignee: Nordson Corporation, Westlake, Ohio

[21] Appl. No.: 08/854,930

[22] Filed: May 13, 1997

[51] Int. Cl.[6] ..... B05C 3/02

[52] U.S. Cl. ..... 118/410; 118/DIG. 10

[58] Field of Search ..... 4325/460, 461, 4325/467, 113; 156/239; 118/DIG. 10, 410, 411, 408, DIG. 1 B; 427/208.2, 207.1, 230, 231

[56] References Cited

U.S. PATENT DOCUMENTS

| | | | |
|---|---|---|---|
| 4,115,172 | 9/1978 | Baboff et al. | 425/460 |
| 4,679,711 | 7/1987 | Trevathan | 222/330 |
| 4,749,125 | 6/1988 | Escallon et al. | 239/3 |
| 4,774,109 | 9/1988 | Hadzimihalis et al. | 427/286 |
| 4,801,051 | 1/1989 | Lewis et al. | 222/309 |
| 5,047,262 | 9/1991 | de Vries et al. | 118/410 |
| 5,277,344 | 1/1994 | Jenkins | 222/504 |
| 5,334,247 | 8/1994 | Columbeu et al. | 118/411 |
| 5,389,151 | 2/1995 | Fort | 118/411 |

*Primary Examiner*—Brenda A. Lamb

*Attorney, Agent, or Firm*—Wood, Herron & Evans, L.L.P.

[57] ABSTRACT

Apparatus for applying uniform layers of adhesive to contoured surfaces of a substrate comprises, in one embodiment, a die head mounted to an adhesive dispenser and having contoured first and second die faces offset relative to each other. One of the die faces is operable to contact the contoured surface of the substrate, and a contoured slot outlet in fluid communication with the adhesive dispenser is disposed between the die faces for applying adhesive material to the contoured surface of the substrate. In another embodiment of the invention for simultaneously applying adhesive to multiple non-coplanar surfaces of a substrate, the die head comprises multiple non-coplanar die faces, each having first and second die face portions offset relative to each other. One of the die face portions of each multiple die face is operable to contact a respective non-coplanar surface of the substrate. A slot outlet communicates with each of the multiple die faces for applying adhesive material to each of the multiple surfaces of the substrate. In yet another embodiment of the invention for applying adhesive material to flexible members of a substrate, a die head comprises first and second die face portions offset relative to each other and contoured to provide a uniform layer of adhesive to the flexible member of the substrate. Methods of applying uniform layers of adhesive to contoured surfaces of a substrate are also disclosed.

21 Claims, 5 Drawing Sheets

METHOD AND APPARATUS FOR APPLYING UNIFORM LAYERS OF ADHESIVE TO CONTOURED SURFACES OF A SUBSTRATE

FIELD OF THE INVENTION

The present invention relates generally to coating apparatus for applying uniform layers of coating material on a substrate and, more particularly, to die structures for use with adhesive dispensers in the application of adhesive on contoured surfaces of a substrate.

BACKGROUND OF THE INVENTION

Contact and non-contact slot nozzle dies for applying uniform layers of adhesive material to planar surfaces of a substrate are known in the art, particularly in the application of adhesives to carton flaps and moving webs, for example. Several known contact and non-contact slot nozzle dies for use with adhesive dispensers include U.S. Pat. Nos. 4,774,109 and 5,389,151, both assigned to Nordson Corporation of Westlake, Ohio, assignee of the present invention. As the terminology would imply, "contact" slot nozzle dies are adapted to contact the substrate during application of the adhesive material, while "non-contact" slot nozzle dies, on the other hand, have a defined spacing or gap between the elongated slot outlet of the die and the moving substrate during the adhesive application process.

In the "contact" application of adhesive material to a substrate, a die head structure is typically mounted to an adhesive dispenser and includes an adhesive channel which terminates in an elongated slot outlet at a lower end of the contact die. The contact die generally includes a back plate, an intermediate shim, and a front plate which are fastened to an adapter mounted to the adhesive dispenser. The intermediate shim typically includes a cut-out region which defines an adhesive channel between the back and front plates of the contact die. The adhesive channel terminates in the elongated slot outlet which is disposed generally transversely to the direction of travel of the moving substrate. The contact die has lower surfaces which lie in a horizontal plane to contact the planar surface of the substrate during the adhesive application process. The back plate of the contact die serves as a doctor blade to remove excess adhesive from the planar surface of the substrate to achieve a uniform layer of adhesive on the substrate.

While "contact" slot nozzle dies have been used widely in the past for applying uniform layers of hot melt adhesive to planar surfaces of a substrate, such as to carton flaps and moving webs, there is a need for a die head structure which is suitable for contact application of adhesive to non-planar, contoured surfaces of a substrate. Additionally, there is a need for a contact die head which is adapted to simultaneously apply uniform layers of adhesive to multiple non-coplanar surfaces of a substrate. Moreover, there is a need for a contact die head structure which accommodates for flexibility in the substrate during the contact application of adhesive.

In the automobile manufacturing industry, for example, there is a need for a contact die structure which is adapted to apply hot melt adhesive layers to contoured surfaces of an automobile weatherstrip. As shown in FIG. 1, a prior art process for the continuous in-line manufacture and flocking of automobile weatherstrips is shown generally as numeral 10. As is know in the art, automobile weatherstrips are designed to be attached around the inside perimeter of a door window frame for providing an impervious barrier or seal between the frame and the window glass. Weatherstrips are generally made of cured rubber material and have a particular configuration or profile for attachment about the perimeter of the door window frame. It is customary in the industry to apply flocking material to surfaces of the weatherstrip which contact the window glass to reduce undesirable friction between the contacting surfaces. The flocking material also serves a cosmetic purpose to provide a decorative surface to the weatherstrip which is partially visible from inside the passenger cabin.

In the known prior art process 10 of FIG. 1, raw material is fed into an extruder 12 which has a die outlet configured to provide the desired profile of the weatherstrip. The raw material is heated within the extruder 12 and forced under pressure through the die outlet. The heated and cured rubber weatherstrip is then conveyed to a water bath 14 where it is cooled before being transported to an adhesive application booth 16.

Adhesive application booth 16 is conventionally used in the in-line manufacturing process 10 to apply solvent-based adhesives to surfaces of the weatherstrip which are to be flocked. Typically, the solvent-based adhesive, such as Lord Corporation's "Flock-Loc" Product No. 7615, has a low flash point so a Halon exhaust system, shown generally as 18, is required to evacuate hazardous solvent effluents 20 from the booth. The solvent-based adhesive is typically dripped (at room temperature) onto selected surfaces of the moving weatherstrip, while brushes or other flexible-type applicators are used to spread the adhesive into layers having desired width and thickness. An exit conveyor 22 is provided downstream of the adhesive booth 16 to transport the weatherstrip to a conventional flocking booth 24 where flocking fibers are applied to the adhesively coated surfaces of the weatherstrip. After the flocking step, the weatherstrip is typically cooled through a cooling conveyor and water bath 26 before being passed downstream for further processing and installation.

It will be appreciated that the application of solvent-based adhesives to the weatherstrip in the prior art process has several disadvantages. The solvent-based adhesives typically have a low viscosity so it is difficult to effectively control application of the adhesive in a uniform layer to selected surfaces of the weatherstrip. Additionally, the brush or flexible-type applicators used to spread the adhesive generally require extensive manual set-up and adjustment in clamp fixtures, and do not provide adequate sharp edge control of the adhesive layers. Moreover, the hazardous nature of the solvent-based flocking adhesives presents environmental and operational concerns in the automobile weatherstrip manufacturing process. It will be appreciated by those skilled in the art that uniformity of the adhesive layers on the weatherstrip is critical in the flocking operation for achieving flocked surfaces which have complete coverage with sharply defined edges.

Accordingly, it is an objective of the present invention to provide an improved adhesive dispensing system which eliminates the use of solvent-based adhesives in the process of manufacturing and flocking automobile weatherstrips. It is also an objective of the present invention to provide an improved adhesive dispensing system which applies more uniform layers of adhesive on selected surfaces of the weatherstrip, with sharper edge control. Moreover, it is also an objective of the present invention to provide an improved adhesive dispensing system which is readily interchangeable to accommodate for different profiles of weatherstrips which may be encountered in the in-line manufacturing and flocking process.

SUMMARY OF THE INVENTION

To these ends, an adhesive dispensing system is provided which comprises various contact die head structures which are adapted to be mounted on respective adhesive dispensers for applying uniform layers of hot melt adhesive to selected contoured surfaces of an automobile weatherstrip. The adhesive dispensers are spaced and aligned along the longitudinal direction of travel of the weatherstrip, and each dispenser includes a respective die head for contacting selected surfaces of the weatherstrip during the adhesive application process.

In one embodiment of the present invention, a die head is mounted to an adhesive dispenser and includes multiple die faces for contacting multiple non-planar inner surfaces of the weatherstrip as it travels relative to the die head. Each of the multiple die faces has forward and rearward die face portions which are offset relative to each other through an offset in the respective die faces. The die head includes an elongated slot which fluidly communicates with each of the forward die face portions for simultaneously applying adhesive to the multiple non-coplanar surfaces of the moving weatherstrip. The rearward die face portions of each die face are operable to contact the weatherstrip as it travels in contact with the die head.

In another embodiment of the invention for applying uniform layers of adhesive to contoured surfaces of the weatherstrip, a die head is mounted to an adhesive dispenser and includes contoured first and second die faces which are preferably concentric and offset relative to each other. Each of the die faces has a profile which approximately matches the profile of the contoured surface of the weatherstrip. A contoured slot outlet in fluid communication with the adhesive dispenser is disposed between the first and second die faces for applying adhesive material to the contoured surface of the weatherstrip. One of the die faces is operable to contact the contoured surface of the weatherstrip, while the other die face functions to doctor off the adhesive to form a uniform layer of adhesive on the contoured surface of the weatherstrip.

In yet another embodiment of the present invention, a contact die head is provided for applying adhesive to flexible members of the weatherstrip. The die head includes contoured first and second die faces which are preferably concentric and offset relative to each other. In this embodiment, each of the die faces has a modified profile which is adapted to accommodate for flexibility in the flexible members of the weatherstrip. A contoured slot outlet in fluid communication with the adhesive dispenser is disposed between the first and second die faces for applying adhesive material in a uniform layer to the flexible member of the weatherstrip.

The above features and advantages of the present invention will become more readily apparent with reference to the accompanying figures and detailed description.

BRIEF DESCRIPTION OF THE DRAWINGS

Reference will now be made to the accompanying figures from which the novel features and advantages of the present invention will be apparent.

DETAILED DESCRIPTION OF THE PREFERRED EMBODIMENTS

Figure 1:
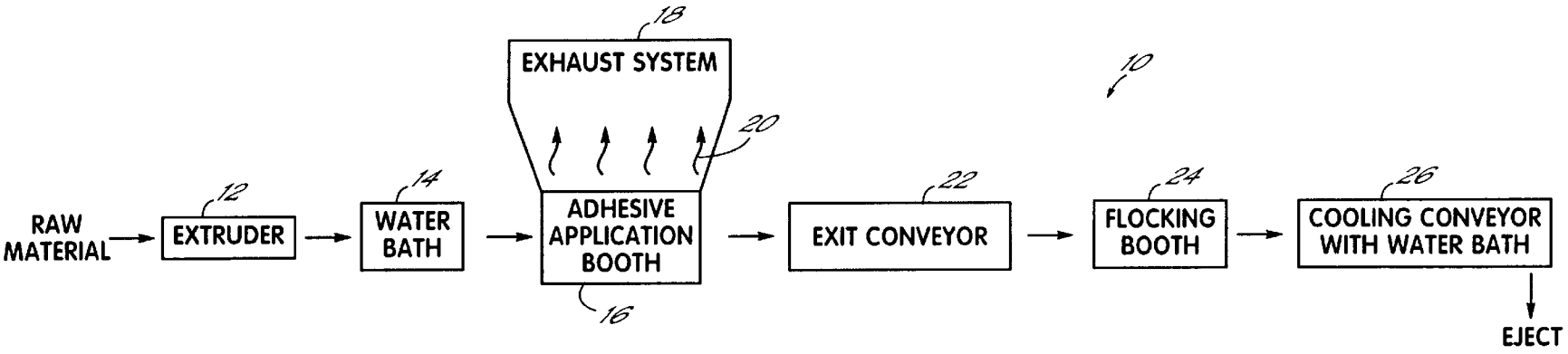
FIG. 1 PRIOR ART
FIG. 1 is a diagrammatic block diagram of a prior art process showing general steps in the continuous in-line manufacture and flocking of an automobile weatherstrip.
Figure 1A:
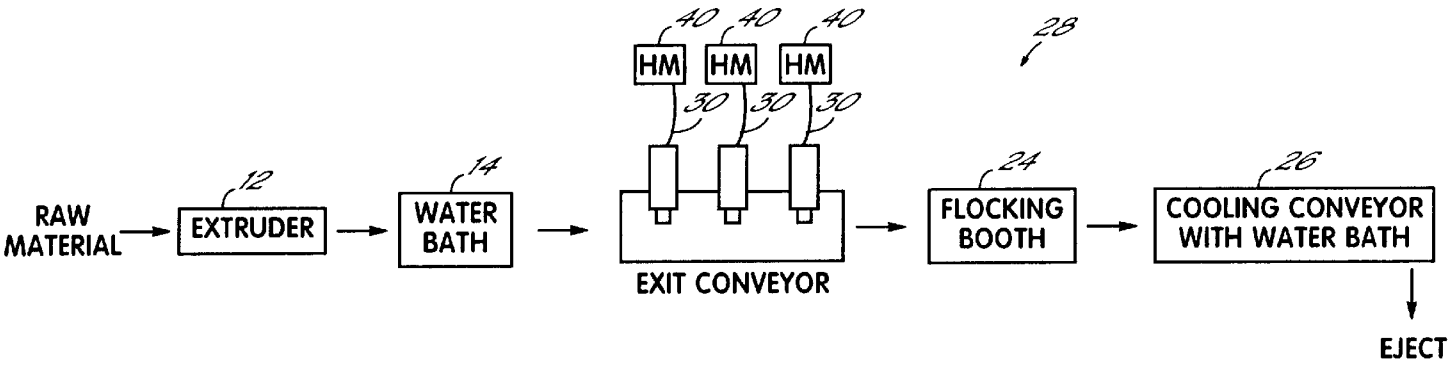
FIG. 1A is a diagrammatic block diagram similar to FIG. 1, but showing adhesive dispensers in accordance with the present invention to replace the adhesive application booth of FIG. 1 for adhesively bonding flocking to the automobile weatherstrip.
Figure 2:
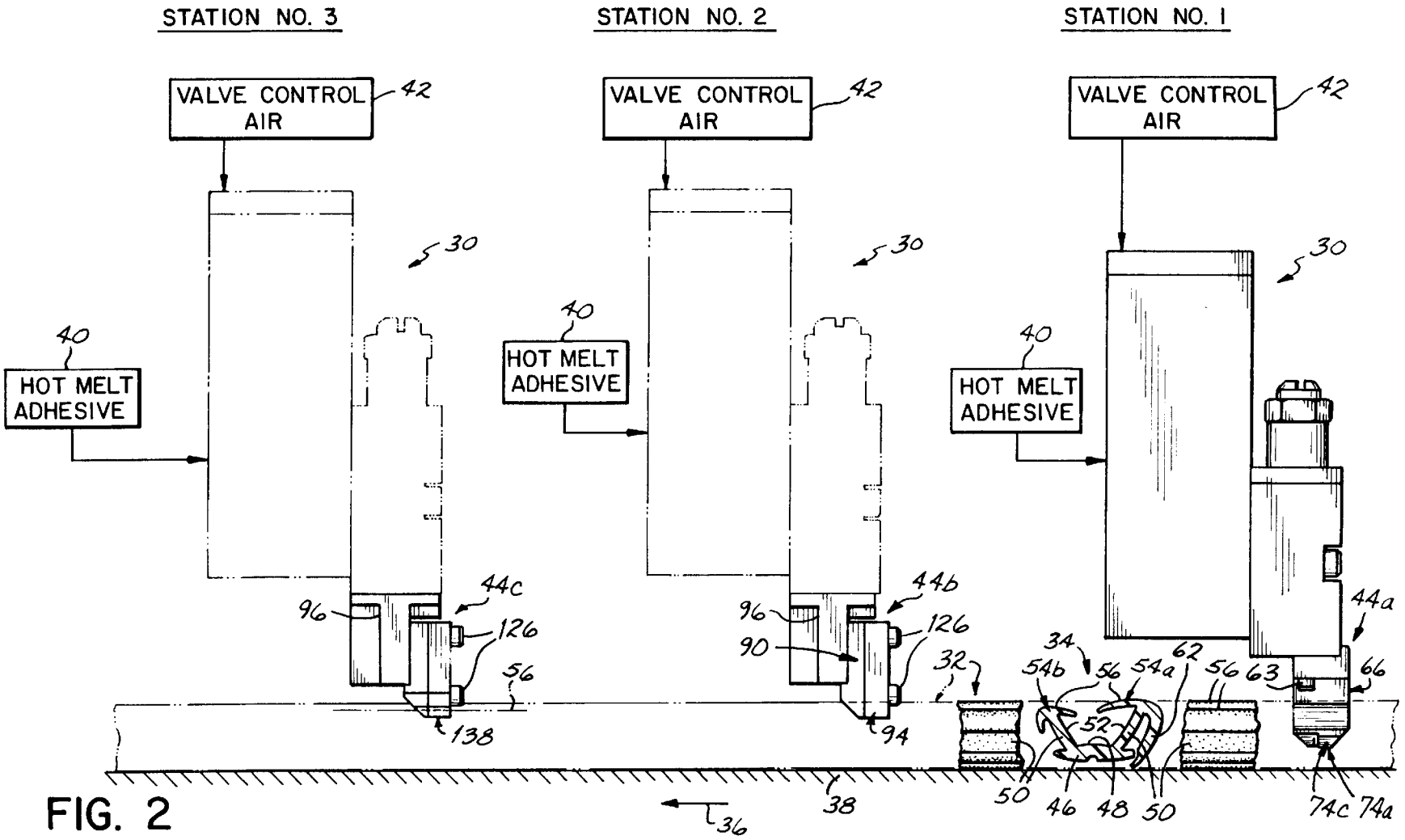
FIG. 2 is an elevational side view showing adhesive dispensers in accordance with the present invention for applying adhesive on multiple surfaces of the automobile weatherstrip manufactured in accordance with the process of FIG. 1A.

Referring to FIG. 1A, a modified process incorporating the features and advantages of the present invention is shown generally as numeral 28. In particular, as shown in FIGS. 1A and 2, the present invention is directed to replacement of the solvent-based adhesive application booth 16 of the prior art process with a series of hot melt dispensers 30 for applying hot melt adhesive on selected surfaces of the weatherstrip to be flocked. Preferably, as will be described in more detail below, the hot melt adhesive applied by dispensers 30 comprises a polyurethane reactive adhesive (also referred to as "PUR" or "moisture-cure" adhesive), such as manufactured by National Starch & Chemical Co. under Product No. 8644-3. The hot melt adhesive is applied to multiple surfaces of the weatherstrip at separate in-line stations, with each station being dedicated to applying adhesive to one or more surfaces of the weatherstrip to be flocked, as will be described in more detail below. It will be appreciated that while the present invention is shown and described with regard to application of hot melt adhesive on selected surfaces of an automobile weatherstrip, the invention in its broader aspects is applicable to a wider range of adhesive applications, as will become more readily apparent below.

Referring to FIG. 2, the features of the present invention are shown in greater detail in the modified process 28 of FIG. 1A for applying hot melt adhesive to multiple surfaces of a moving weatherstrip 32 having the cross-sectional profile 34 as shown in the figure. In accordance with the present invention, the series of hot melt dispensers 30 are aligned in spaced relationship along the longitudinal direction of travel of the weatherstrip 32, represented by directional arrow 36, which is supported on a moving conveyor, shown diagrammatically by numeral 38. The dispensers 30 are preferably Model H200 hot melt dispensers supplied by Nordson Corporation of Westlake, Oh., which do not form any part of the present invention per se. The hot melt dispensers 30 receive PUR hot melt adhesive from respective bulk melters 40 (see FIGS. 1A and 2) which are preferably Model BM/506 bulk melters manufactured by Nordson Corporation. The details of the structure and operation of Nordson's H200 hot melt dispenser may be found in U.S. Pat. Nos. 4,801,051 and 5,277,344, both of which are expressly incorporated herein by reference in their entirety. In brief herein, the hot melt dispensers 30 each include a vertically oriented valve structure (not shown) which is operable, through valve control air 42, to provide controlled continuous or intermittent supply of hot melt adhesive to respective die heads 44*a,* 44*b* and 44*c* which are mounted on a lower end of the dispensers 30. As will be described in more detail below, the die heads 44*a,* 44*b* and 44*c* of the present invention are mounted to the respective hot melt dispensers 30 for applying hot melt adhesive to selected surfaces of the automobile weatherstrip 32 as it travels in contact with the die heads in the direction of travel represented by arrow 36.

As shown in the profile cross-sections of FIG. 2, 3, 6 and 9, one embodiment of an automobile weatherstrip 32 includes a base member 46 having an inner surface 48, a pair of upstanding side walls 50 having respective inner surfaces 52, and a pair of flexible members 54*a* and 54*b* having respective upper surfaces 56. The flexible members 54*a* and 54*b* have respective ends 58 which are supported by the side walls 52, and remote ends 60 which are cantilevered by their respective side walls. A flange member 62 is integrally formed on the automobile weatherstrip 32 to facilitate installation of the weatherstrip in a door window frame as is well known in the art.

After installation of the automobile weatherstrip 32 in a door window frame, the weatherstrip provides a seal between the window frame and the window glass. During operation of the window, the glass contacts the inner surface 48 of base member 46 and the upper surfaces 56 of respective flexible members 54*a* and 54*b*. To reduce friction between the weatherstrip 32 and the window glass, the inner surface 48 of base member 46, partial inner surfaces 52 of the sidewalls 50, and the upper surfaces 56 of flexible members 54*a* and 54*b* are typically flocked with flocking fibers. To this end, as will be described in more detail below, the respective die heads 44*a,* 44*b* and 44*c* of the present invention are configured to apply a continuous layer of hot melt adhesive to these selected surfaces of the weatherstrip 32 before it enters the flocking booth 24 (FIG. 1A).

Figure 3:
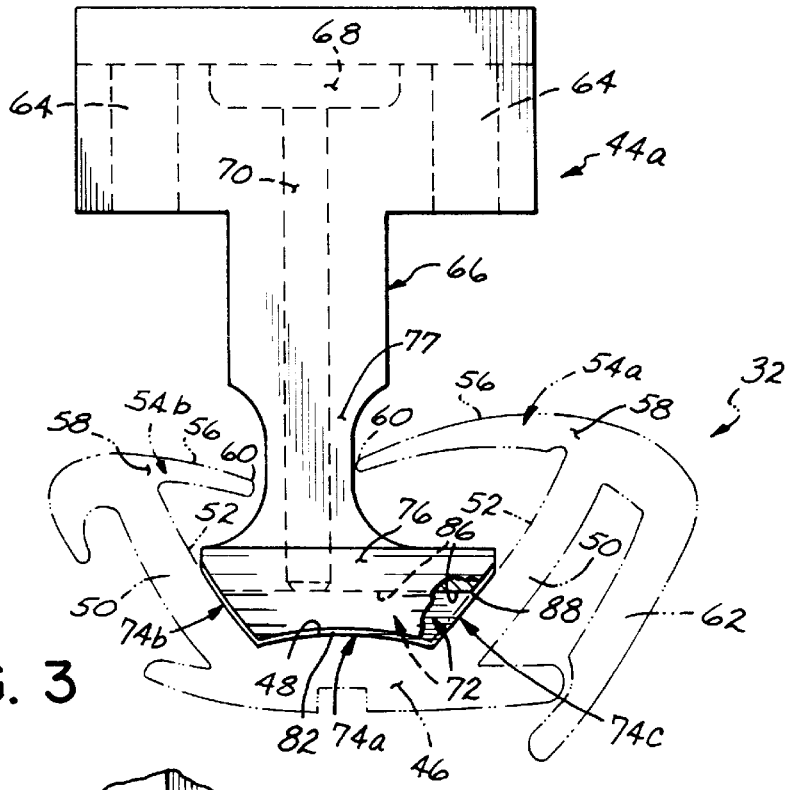
FIG. 3 is a front elevational view of a die head structure in accordance with a first embodiment of the present invention for applying adhesive on multiple non-coplanar surfaces of the automobile weatherstrip.
Figure 4:
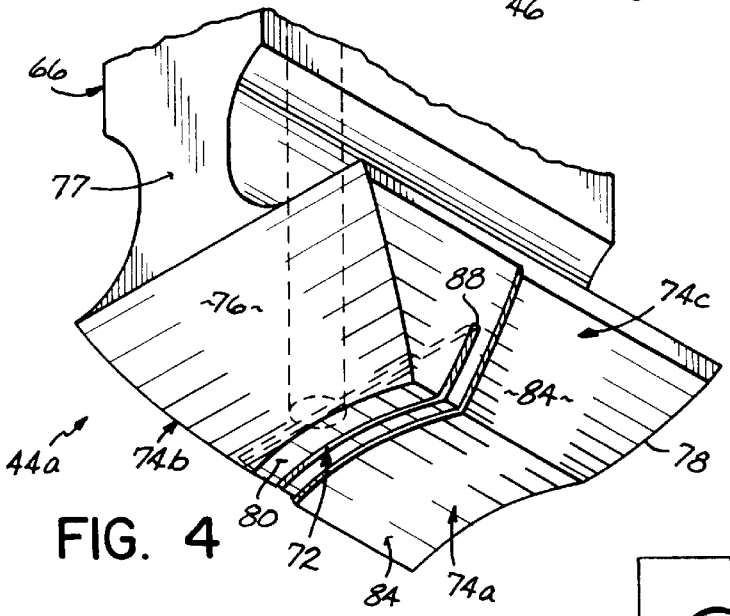
FIG. 4 is an enlarged perspective view of the die head structure shown in FIG. 3.
Figure 5:
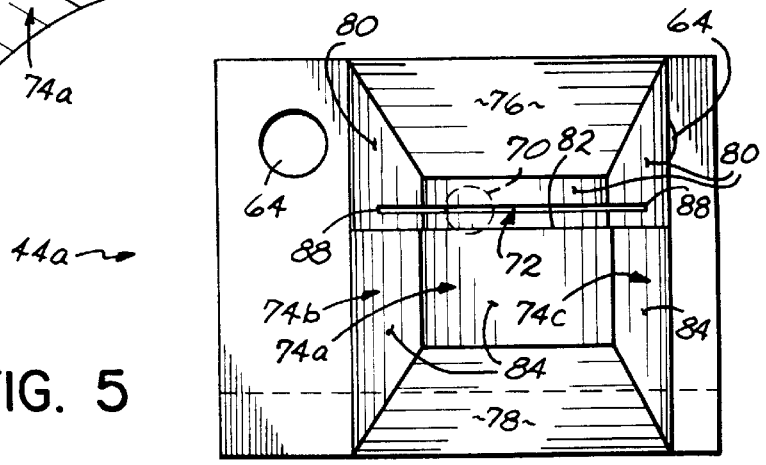
FIG. 5 is bottom plan view of the die head structure shown in FIGS. 3 and 4.
Figure 9:
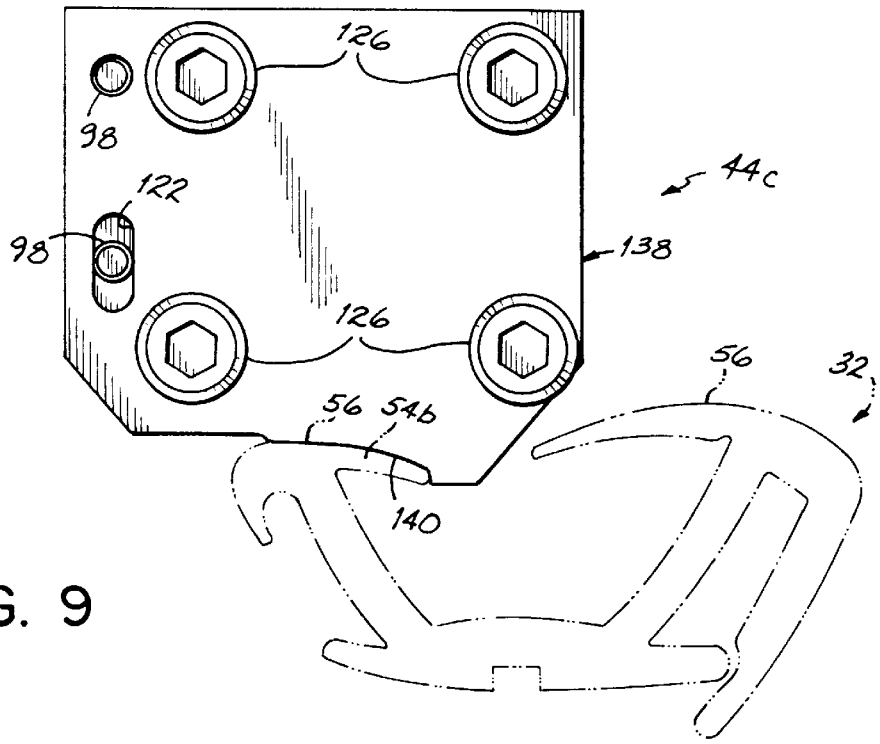
FIG. 9 is a front elevational view similar to FIG. 6, but showing a component of a die head structure in accordance with a third embodiment of the present invention for applying adhesive on a second flexible member of the automobile weatherstrip.

In one embodiment of the present invention as shown in FIG. 2, die head 44*a* of Station No. 1 is configured to simultaneously apply hot melt adhesive to the inner surface 48 of base member 46 and partially upwardly on the respective inner surfaces 52 of the upstanding side walls 50 (FIGS. 3–5). Die head 44*b* of Station No. 2 is configured to apply hot melt adhesive to the upper surface 56 of flexible member 54*a* (FIG. 6), while die head 44*c* of Station No. 3 is configured to apply adhesive to upper surface 56 of flexible member 54*b* (FIG. 9). It will be appreciated by those skilled in the art that the order of the adhesive dispensing stations is not necessarily critical, although the position of Station No. 1 with die head 44*a* as the first dispensing station to contact the weatherstrip 32 is preferred to aid in alignment of the weatherstrip as it travels in longitudinal contact with the respective die heads 44*a,* 44*b* and 44*c* through the adhesive application process. While not shown, it will also be appreciated that edge guides may be disposed along opposite longitudinal edges of the weatherstrip 32 to further aid in alignment of the weatherstrip through the adhesive application process.

Now referring to FIGS. 3–5, the details of die head 44*a* of Station No. 1 is shown for simultaneously applying adhesive to multiple non-coplanar surfaces of the weatherstrip 32. As shown in FIG. 3, die head 44*a* is preferably an integral die component which attaches to a respective adhesive dispenser 30 through fasteners 63 (FIG. 2) which extend through vertically aligned bores 64. Die head 44*a* includes a die body 66 having an elongated adhesive cavity 68 which is in fluid communication with a respective adhesive dispenser 30. An adhesive passageway 70 extends through the die body 66 to fluidly connect the elongated adhesive cavity 68 with an elongated slot 72 disposed at a remote end of the die head 44*a*.

In accordance with one aspect of the present invention, die head 44*a* includes a bottom die face 74*a* (as viewed in FIGS. 3–5) which is configured to apply hot melt adhesive to the inner surface 48 of base member 46, a side die face 74*b* which is configured to apply adhesive partially upwardly on the inner surface 52 of one of the sidewalls 50, and another side die face 74*c* which is configured to apply adhesive partially upwardly on the inner surface 52 of the other sidewall 50. Die head 44*a* further includes a front die face 76 and a rear die face 78 (as viewed in FIGS. 3–5) which converge toward the bottom die face 74*a*. For sake of clarity, rear die face 78 is on the leading or upstream side of die head 44*a,* while front die face 76 is on the trailing or downstream side of the die head. As shown most clearly in FIGS. 3 and 4, die body 66 has a reduced body section 77 which is adapted to permit die head 44*a* to contact the inner surfaces 48 and 52 of weatherstrip 32 without having the die body 66 contact the flexible members 54*a* and 54*b* of the weatherstrip during the adhesive application process. As shown most clearly in FIGS. 4 and 5, each of the respective bottom and side die faces 74*a,* 74*b* and 74*c* has a forward die face portion 80 which is offset, through an offset 82, from a rearward die face portion 84 of each respective die face (as viewed in FIGS. 3–5). The rearward die face portions 84 are on the leading or upstream side of die head 44*c,* and forward die face portions 80 are on the trailing or downstream side of the die head. Preferably, the offset between the respective forward and rearward die face portions 80 and 84 of each die face is about 0.002" to about 0.003". It will be appreciated that offset 82 may comprise a substantially abrupt step as shown, although a taper or chamfer between the respective forward and rearward die face portions 80 and 84 of each die face is also contemplated.

The elongated slot 72 is preferably formed through an EDM process as a continuous open slot which is in fluid communication with each of the forward die face portions 80 of respective bottom and side die faces 74*a,* 74*b* and 74*c*. Preferably, the elongated slot has a gap width of about 0.010". The elongated slot 72 includes a substantially planar upper edge 86 (FIGS. 3 and 4) which defines upper slot edges 88 on the respective side die faces 74*b* and 74*c*. The upper slot edges 88 define the upper edges of the adhesive layers applied to the inner surfaces 52 of sidewalls 50. While the elongated slot 72 is shown with a substantially planar upper edge 86 in fluid communication with the adhesive passageway 70, it is also contemplated that the upper edge 86 of the slot could be non-planar or "fan-shaped" without departing from the spirit or scope of the present invention. In an alternative embodiment of the present invention, it is also contemplated that the elongated slot 72 could be segmented into a plurality of outlets to change the adhesive pattern applied by the die head 44*a*. The rearward die face portions 84 of respective die faces 74*a,* 74*b* and 74*c* are operable to contact the weatherstrip 32 as it travels in the direction of arrow 36 (FIG. 2) relative to the die head 44*a* during the adhesive application process.

As shown in the profile cross-section of the weatherstrip 32 (FIG. 3), the inner surface 48 of the base member 46 is rounded or contoured. To accommodate application of adhesive to this non-planar surface, the forward and rearward die face portions 80 and 84 of bottom die face 74*a* are contoured to approximately match the profile of the inner surface 48. The elongated slot 72, which is in fluid communication with the forward die face portion 80 of die face 74*a,* is likewise contoured to approximately match the profile of the inner surface 48. In similar fashion, the forward and rearward die face portions 80 and 84 of side die faces 74*b* and 74*c* are also contoured to approximately match the non-planar profiles of the inner surfaces 52 of sidewalls 50. Thus, in one preferred embodiment of the present invention, the forward and rearward die face portions 80 and 84 of respective die faces 74*a,* 74*b* and 74*c* are concentrically offset by offset 82 and contoured to approximately match the inner surface profiles of the weatherstrip 32. Likewise, the elongated slot 72 is contoured, as defined by the contour of the forward die face portions 80 of respective die faces 74*a,* 74*b* and 74*c,* to approximately match the non-planar inner surface profiles of weatherstrip 32.

In operation of die head 44*a* at Station No. 1, the die body 66 is positioned between the flexible members 54*a* and 54*b* to permit the rearward die face portions 84 of die faces 74*a,* 74*b* and 74*c* to contact the respective inner surfaces 48 and 52 of the weatherstrip 32. Adhesive material is supplied by an adhesive dispenser 30 (FIGS. 1A and 2) to the elongated slot 72 through the elongated adhesive cavity 68 and the adhesive passageway 70. Backpressure created by the interference between the die head 44*a* and the weatherstrip 32 ensures that the elongated slot 72 is uniformly filled with adhesive. The weatherstrip 32 is moved relative to the die head 44*a* in the direction of travel indicated by arrow 36 in FIG. 2 such that the respective rearward die face portions 84 of die head 44*a* contact the weatherstrip on the upstream side of travel, while the respective slots 72 in the forward die face portions 80 of the die head apply uniform layers of adhesive, preferably about 0.002" to about 0.003" in thickness, to the inner surfaces 48 and 52 of the weatherstrip on the downstream side of travel. The forward die face portions 84 of respective die faces 74*a,* 74*b* and 74*c* function to doctor off the adhesive to form uniform layers of adhesive on the inner surfaces 48 and 52 of the weatherstrip. It will be appreciated that the structure of die head 44*a* thus provides for simultaneous contact application of adhesive layers to multiple inner surfaces of the weatherstrip 32 as it travels relative to the die head. Additionally, it will be appreciated that die head 44*a* provides for contact application of adhesive in uniform layers to contoured inner surfaces of the weatherstrip 32 during the adhesive application process.

Figure 6:
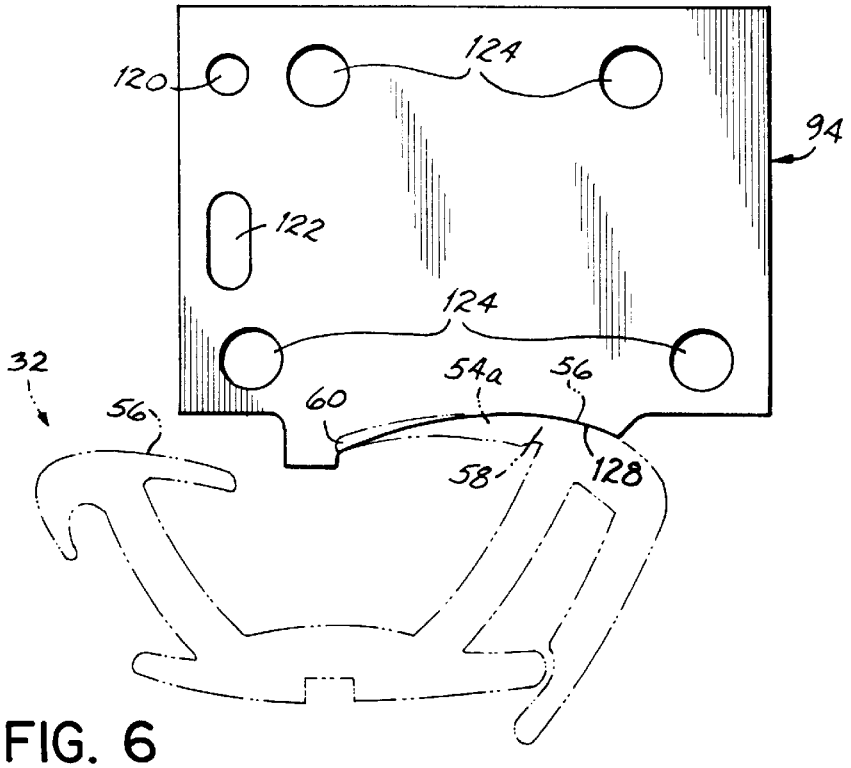
FIG. 6 is a front elevational view of a component of a die head structure in accordance with a second embodiment of the present invention for applying adhesive on a first flexible member of the automobile weatherstrip.
Figure 7:
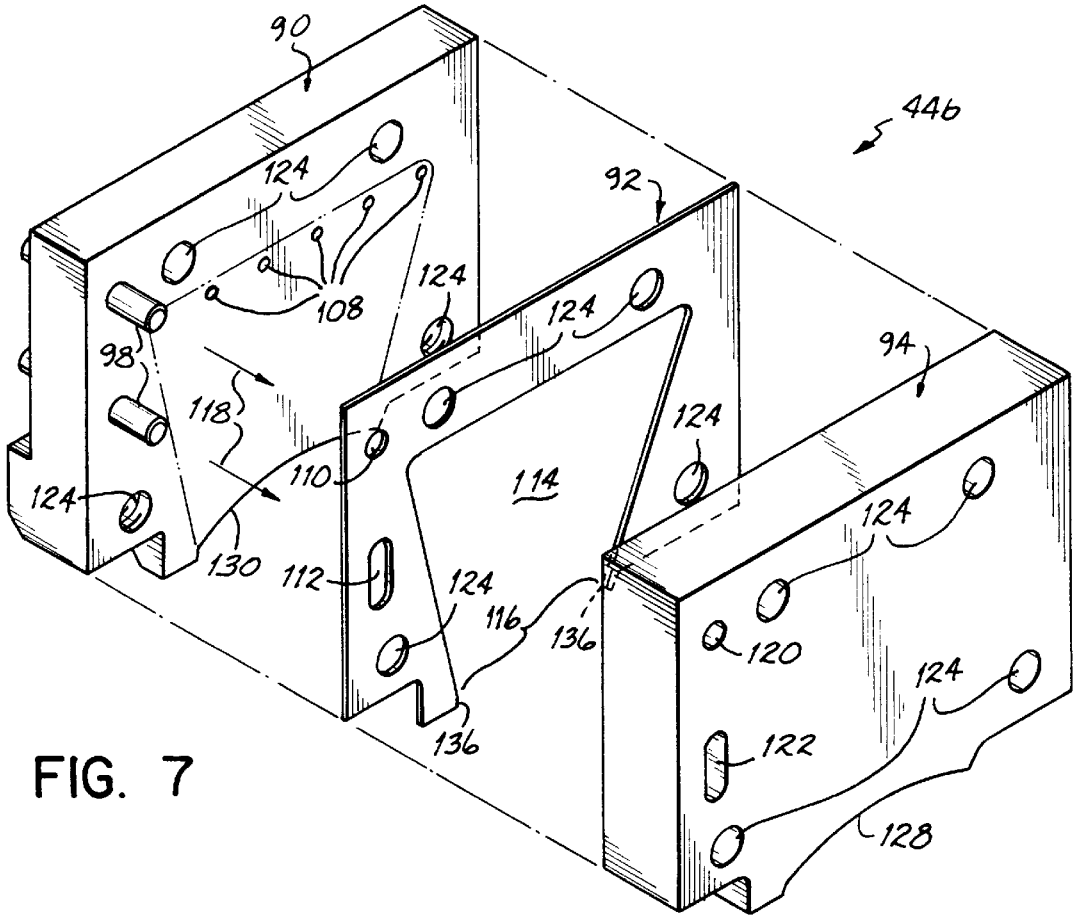
FIG. 7 is an exploded perspective view showing multiple components of a die head structure in accordance with the second embodiment of the present invention.
Figure 8:
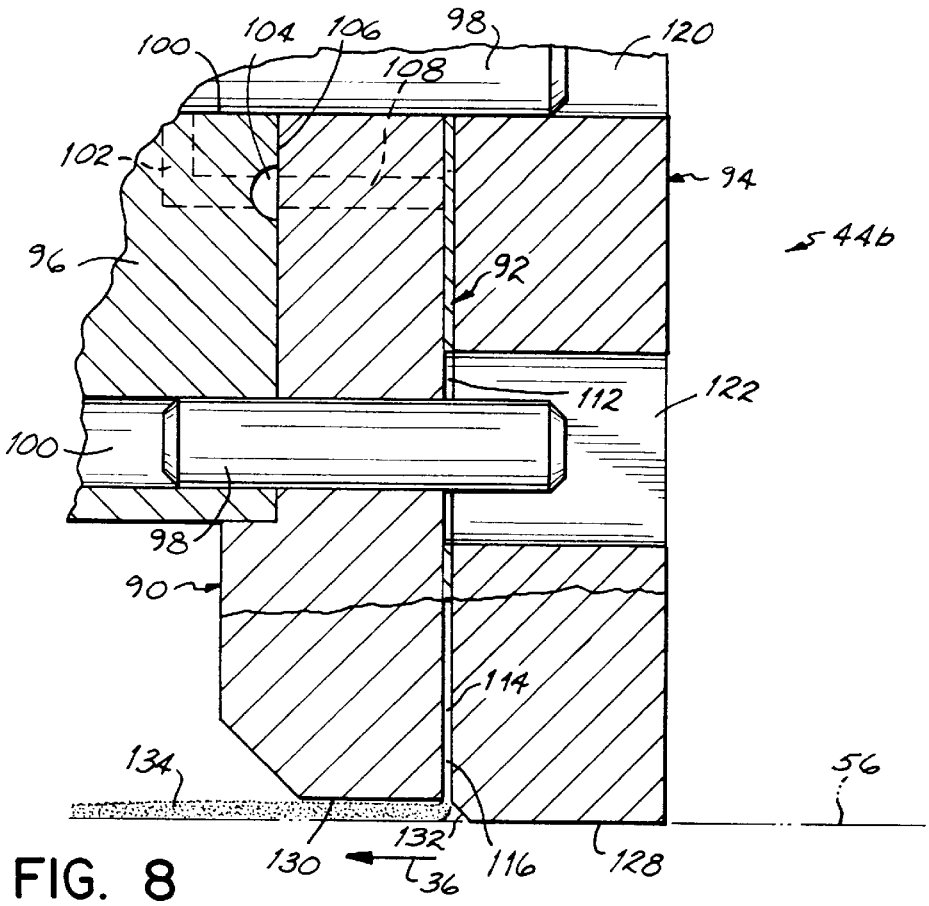
FIG. 8 is a side elevational view, partially in cross-section, showing the multiple components of the die head structure shown in FIG. 7 assembled in accordance with the present invention.

With reference now to FIGS. 6–8, structure of the die head 44*b* is shown for applying a uniform layer of adhesive to the upper surface 56 of flexible member 54*a* which has a non-planar, contoured profile. In particular, as shown in FIGS. 7 and 8, die head 44*b* includes a distribution blade 90, an intermediate shim 92, and a wear blade 94 which are adapted to be mounted on a lower end of an adhesive dispenser 30 through an adapter 96 (FIGS. 2 and 8). As will be described in more detail below, the assembled distribution blade 90, intermediate shim 92 and wear blade 94 form a doctor blade assembly which is particularly adapted for contact application of adhesive to the contoured upper surface 56 of flexible member 54*a*.

As shown most clearly in FIGS. 7 and 8, distribution blade 90 preferably includes a pair of registration pins 98 which extend from opposite sides of the blade and which are adapted to be received, on one side of the blade, in registration bores 100 of adapter 96. Adapter 96 has an adhesive passageway 102 which fluidly communicates between an adhesive dispenser 30 (FIG. 2) and an elongated cavity 104 formed in a planar face 106 of the adapter 96. For purposes to be described in more detail below, the distribution blade 90 preferably includes a series of six (6) spaced adhesive conduits 108 which fluidly communicate with the elongated adhesive cavity 104 of adapter 96 for creating adhesive backpressure between the distribution blade 90 and the adapter 96.

Intermediate shim 92 includes a registration aperture 110 and a slot 112 which are adapted to cooperate with the registration pins 98 extending from the other side of the distribution blade 90. As will be described in more detail below, intermediate shim 92 includes a pyramidal-shaped cut-out region 114 which is adapted to receive adhesive from the spaced adhesive conduits 108 of the distribution blade 90 and to deliver the adhesive to an elongated slot 116 (FIG. 8) formed by the assembly of the distribution blade 90, intermediate shim 92 and wear blade 94 as represented by arrows 118 of FIG. 7. In particular, the volume created by the cut-out region 114 of intermediate shim 92 is bounded by planar surfaces of the distribution and wear blades 90 and 94, respectively, and terminates in the elongated slot 116.

The wear blade 94 also includes a registration aperture 120 and a slot 122 which are adapted to cooperate with the registration pins 98 extending from the one side of the distribution blade 90. It will be understood by those skilled in the art that the slots 112 and 122 in the respective intermediate shim 92 and wear blade 94 are provided to accommodate for thermal expansion of the die head components caused by heat generated during the hot melt adhesive coating process. Each of the distribution blade 90, intermediate shim 92 and wear blade 94 includes apertures 124 for receiving a series of fasteners 126 like those in Station No. 3 (FIG. 9) which attach the die heads 44*b* and 44*c* to the adaptor 96. The fasteners 126 must be applied with sufficient force to provide a hydraulic seal between the cut-out region 114 of the intermediate shim 92 and the respective distribution and wear blades 90 and 94.

Further referring to FIGS. 6–8, wear blade 94 has a die face 128 which is adapted to contact the contoured upper surface 56 of flexible member 54*a*. The distribution blade 90 preferably has a die face 130 which is offset from the die face 128 of wear blade 94 through a 45° chamfer 132 formed on the wear blade. Preferably, the offset is about 0.002" to about 0.003" to create a uniform layer 134 of adhesive (FIG. 8) having the approximate thickness of the offset. The thickness of the intermediate shim 92 (preferably in one embodiment about 0.006") defines the gap width of the elongated slot 116 which terminates at the die face 130 of the distribution blade 90 as shown most clearly in FIG. 8. The intermediate shim 92 includes opposite lateral edges 136 (FIG. 7) extending to the elongated slot 116 which define the sharp edges of the adhesive layer 134.

Due to the construction of the flexible member 54*a* having the supported end 58 and the cantilevered end 60, it will be appreciated by those skilled in the art that a downward constant force or pressure applied to the contoured upper surface 56 of the flexible member 54*a* will cause the cantilevered end 60 to deflect a greater distance than the supported end 58. However, it is contemplated that in order to achieve an adhesive layer 134 of uniform thickness across the entire profile of the flexible member 54*a,* it is necessary that the hydraulic pressure of the adhesive across the elongated slot 116 be substantially uniform between the supported and cantilevered ends 58 and 60 of the flexible member 54*a*.

To this end, in accordance with the present invention as shown most clearly in FIG. 6, the die face 128 of wear blade 94 has a profile which is adapted, upon contact of the die face with the upper surface 56 of flexible member 54*a*, to apply a greater pressure to the cantilevered end 60 relative to that applied to the supported end 58. In the relaxed state of the flexible member 54*a*, the upper surface 56 of the flexible member assumes the profile shown in phantom in FIG. 6. However, rather than having the profile of the die face 128 match the relaxed profile of the flexible member 54*a*, the die face profile is modified to create a greater interference at the cantilevered end 60 relative to that created at the supported end 58 upon contact of the die face with the flexible member 54*a*. In this way, a substantially constant hydraulic pressure will preferably be created across the entire upper surface 56 of the flexible member 54*a* between the respective supported and cantilevered ends 58 and 60. The die face 130 of distribution blade 90 is preferably concentric with, and offset from (by chamfer 132), die face 128 of wear blade 94.

It is contemplated that the modified profile of the die face 128 can be approximated by first creating a deflection profile of the flexible member 54*a* in response to a constant downward force applied to the upper surface 56 of the flexible member. Thus, for example, a deflection profile may demonstrate that the cantilevered end 60 deflects 15% more than the supported end 58 in response to a constant force applied to the upper surface 56 of the flexible member 54*a*. Next, the relaxed curve profile of the upper surface 56 of the flexible member 54*a*, which is preferably available from a CAD database, is modified using the deflection profile data already obtained to define a modified profile for the die face 128. In this regard, a curve approximation is performed on the relaxed curve profile of the flexible member 54*a* to modify it with the deflection profile data already obtained. Thus, in the example given, the relaxed curve profile of the flexible member 54*a* would be modified to include up to a 15% increase in the interference between die face 128 and flexible member 54*a* at the cantilevered end 60. In this way, it will be appreciated that the greater interference created by the modified curve profile of the die face 128 at the cantilevered end 60 relative to that created at the supported end 58 will preferably create a substantially constant hydraulic pressure across the upper surface 56 of the flexible member 54*a* upon contact with the die face 128 of the wear blade 94.

In operation of die head 44*b* at Station No. 2, the die head is positioned to provide contact between die face 128 of wear blade 94 and the upper surface 56 of flexible member 54*a*. Adhesive material is supplied by an adhesive dispenser 30 (FIG. 2) to the cut-out region 114 of intermediate shim 92 through the adhesive passageway 102 in adapter 96 and the adhesive conduits 108 in distribution blade 90. Backpressure is created by the adhesive conduits 108 in the distribution blade 90 to ensure that the cut-out region 114 is uniformly filled with adhesive. The die face 128 of wear blade 94 creates a greater interference at the cantilevered end 60 of the flexible member 54*a* relative to that created at the supported end 58 to preferably provide a substantially constant hydraulic pressure at the elongated slot 116. The weatherstrip 32 is moved relative to the die head 44*b* in the direction of travel indicated by arrow 36 in FIG. 8 such that a uniform adhesive layer 134 of adhesive, preferably about 0.002" to about 0.003" in thickness, is applied to the upper layer 56 of the flexible member 54*a*. The die face 130 functions to doctor off adhesive to form a uniform layer of adhesive on the upper surface 56 of flexible member 54*a*. It will be appreciated that the structure of die head 44*b* thus provides for uniform contact application of adhesive on the upper surface 56 of the flexible member 54*a* with sharply defined edges as defined by the opposite lateral edges 136 of intermediate shim 92. It will also be appreciated that die head 44*b* provides for contact application of adhesive in a uniform layer to the contoured upper surface 56 of flexible member 54*a*.

As shown in FIG. 9, die head 44*c* of Station No. 3 is shown for applying an adhesive layer to the upper surface 56 of flexible member 54*b*. The construction and operation of die head 44*c* is similar to that of die head 44*b*. In particular, a wear blade 138 is provided having a die face 140 which includes a modified curve profile to accommodate for flexibility of flexible member 54*b* as described in detail above with regard to flexible member 54*a*. Die head 44*c* further includes a distribution blade (not shown) which preferably has a die face concentric with, and offset from, die face 140. An intermediate shim (not shown) is also provided as described in detail above to create an elongated slot for applying a uniform layer of adhesive to the upper surface 56 of flexible member 54*b* as die face 140 of wear blade 138 contacts the flexible member.

In each of the embodiments shown and described, it is contemplated that several factors will affect the thickness of adhesive layers applied to the selected surfaces of weatherstrip 32, including: 1) the travel speed of the weatherstrip, 2) the gap width of the elongated slots in the respective die heads, 3) the hydraulic pressure at which the adhesive is applied, 4) the offset between the respective die face portions, and 5) the viscosity of the adhesive. Those skilled in the art will readily appreciate that by increasing or decreasing any one of these factors, the desired thickness of the adhesive layer may be obtained for a given application. While not shown, it will also be appreciated that each of the adhesive dispensers 30 (FIG. 2) which support respective die heads 44*a*, 44*b* and 44*c* are preferably mounted in adjustable X–Y fixtures of conventional design to accurately position each die head in proper contact with the weatherstrip 32 as described above.

Thus, it will be appreciated by those skilled in the art that the present invention provides numerous advantages over the solvent-based flocking adhesive application booth 16 of the prior art. In particular, the hot melt adhesive dispensers and die head configurations of the present invention provide for more uniform layers of adhesive to be applied on selected surfaces of the weatherstrip, with sharper edge control, than the brush-type or flexible adhesive applicators of the prior art. The improved control of the adhesive application process as provided by the die heads of the present invention contributes to more uniform application of flocking material on the weatherstrip. The contoured die faces and contoured elongated slots of the various die heads provide for advantageous contact application of adhesive to one or more contoured surfaces of the weatherstrip. Additionally, the use of hot melt adhesives and adhesive dispensers eliminates the environmental and operational concerns associated with the solvent-based flocking adhesives of the prior art. Moreover, the die head configurations are readily interchangeable to accommodate for different profiles of weatherstrips which may be encountered in the in-line manufacturing and flocking process.

From the above disclosure of the general principles of the present invention and the preceding detailed description of preferred embodiments, those skilled in the art will readily comprehend the various modifications to which the present invention is susceptible. For example, while moisture-cure (PUR) adhesives is preferred, other adhesives of different viscosity or properties may be used without departing from the spirit and scope of the present invention. Additionally, while continuous open elongated slots in the die heads have been illustrated in the figures, it is contemplated that the elongated slots could be segmented to include a series of adhesive outlets, thereby modifying the adhesive pattern applied to surfaces of the weatherstrip. Thus, the invention in its broader aspects is therefore not limited to the specific details and illustrative examples shown and described. Accordingly, departures may be made from such details without departing from the spirit or scope of Applicant's general inventive concept. Therefore, Applicant desires to be limited only by the scope of the following claims and equivalents Having described the invention, I claim:

1. A system for applying fluid material to multiple non-coplanar surfaces of a substrate, comprising:

a fluid dispenser;

a die body operably connected to said dispenser and having a supply passage in fluid communication with said dispenser for receiving fluid material therefrom; and a die head disposed at a remote end of said die body and having a first die face formed at a remote end thereof and a pair of spaced second die faces intersecting said first die face, each of said first and second die faces having a first die face portion offset relative to a second die face portion thereof whereby each of said second die face portions is operable to contact a respective one of said non-coplanar surfaces of said substrate, said die head further having an outlet in fluid communication with each of said first die face portions and said supply passage of said die body for applying fluid material to said non-coplanar surfaces of said substrate.

2. The apparatus of claim 1 wherein said outlet comprises a continuous open slot in fluid communication with each of said first die face portions.

3. The apparatus of claim 1 wherein said outlet comprises a segmented slot in fluid communication with each of said first die face portions.

4. The apparatus of claim 1 wherein at least one of said first die face portions is contoured.

5. The apparatus of claim 4 wherein said outlet in fluid communication with said at least one first die face portion is contoured.

6. A system for applying fluid material to multiple non-coplanar surfaces of a substrate, comprising:

a fluid dispenser;

a die body operably connected to said dispenser and having a supply passage in fluid communication with said dispenser for receiving fluid material therefrom; and a die head disposed at a remote end of said die body and having a first die face formed at a remote end thereof and a pair of spaced second die faces intersecting said first die face, each of said first and second die faces having a first die face portion offset relative to a second die face portion thereof whereby each of said second die face portions is operable to contact a respective one of said non-coplanar surfaces of said substrate, said die head further having a slot outlet in fluid communication with each of said first die face portions and said supply passage of said die body for applying fluid material to said non-coplanar surfaces of said substrate in a substantially uniform layer.

7. The apparatus of claim 6 wherein at least one of said first die face portions is contoured.

8. The apparatus of claim 7 wherein said slot outlet in fluid communication with said at least one first die face portion is contoured.

9. Apparatus for use with a dispenser in the application of fluid material to multiple non-coplanar surfaces of a substrate moving relative to said dispenser, comprising:

a die head having a first die face formed at a remote end thereof and a pair of spaced second die faces intersecting said first die face, each of said first and second die faces having a first die face portion offset relative to a second die face portion thereof whereby each of said second die face portions is operable to contact a respective one of said non-coplanar surfaces of said substrate, said die head further having an outlet in fluid communication with each of said first die face portions for applying fluid material to said non-coplanar surfaces of said substrate.

10. The apparatus of claim 9 wherein said outlet comprises a continuous open slot in fluid communication with each of said first die face portions.

11. The apparatus of claim 9 wherein said outlet comprises a segmented slot in fluid communication with each of said first die face portions.

12. The apparatus of claim 9 wherein said first die face is formed concave.

13. Apparatus for use with a dispenser in the application of fluid material to multiple non-coplanar surfaces of a substrate moving relative to said dispenser, comprising:

a die head having a concave die face formed at a remote end thereof and a pair of spaced die faces extending away from said concave die face, each of said die faces having a first die face portion offset relative to a second die face portion thereof whereby each of said second die face portions is operable to contact a respective one of said non-coplanar surfaces of said substrate, said die head further having an outlet in fluid communication with each of said first die face portions for applying fluid material to said non-coplanar surfaces of said substrate.

14. The apparatus of claim 13 wherein said outlet comprises a continuous open slot in fluid communication with each of said first die face portions.

15. The apparatus of claim 13 wherein said outlet comprises a segmented slot in fluid communication with each of said first die face portions.

16. Apparatus for use with a dispenser in the application of fluid material to multiple non-coplanar surfaces of a substrate moving relative to said dispenser, comprising:

a die head having a first die face formed at a remote end thereof and a pair of spaced second die faces extending angularly away from said first die face, each of said first and second die faces having a first die face portion offset relative to a second die face portion thereof whereby each of said second die face portions is operable to contact a respective one of said non-coplanar surfaces of said substrate, said die head further having an outlet in fluid communication with each of said first die face portions for applying fluid material to said non-coplanar surfaces of said substrate.

17. The apparatus of claim 16 wherein said outlet comprises a continuous open slot in fluid communication with each of said first die face portions.

18. The apparatus of claim 16 wherein said outlet comprises a segmented slot in fluid communication with each of said first die face portions.

19. A fluid material dispensing die head in combination with a substrate, wherein said substrate is operable to move relative to said die head and includes a flexible member having a supported end and a cantilevered end operable to deflect a greater distance than said supported end in response to a constant pressure applied to said flexible member, and further wherein said die head includes a first die face portion offset relative to a second die face portion thereof, whereby said second die face portion is operable to contact said flexible member between said cantilevered and supported ends and is contoured to apply a greater pressure to said cantilevered end relative to that applied to said supported end upon contact with said flexible member, said die head further having an outlet for applying fluid material to said flexible member in a substantially uniform layer between the cantilevered and supported ends.

20. The apparatus of claim 19 wherein said outlet comprises a continuous open slot.

21. The apparatus of claim 19 wherein said outlet comprises a segmented slot.

* * * * *